United States Patent [19]

Todd, Sr.

[11] 4,320,569

[45] Mar. 23, 1982

[54] METHOD OF FABRICATING A SHEATH FOR A KNIFE

[76] Inventor: Lowell H. Todd, Sr., 324 Green Dr., Pasadena, Md. 21122

[21] Appl. No.: 187,645

[22] Filed: Sep. 16, 1980

Related U.S. Application Data

[62] Division of Ser. No. 91,387, Nov. 5, 1979, Pat. No. 4,263,714.

[51] Int. Cl.[3] ..... B21D 35/00

[52] U.S. Cl. ..... 29/469.5; 29/526 R; 156/92

[58] Field of Search ..... 29/526 R, 432, 469.5; 30/151; 224/232; 156/91, 92, 93

[56] References Cited

U.S. PATENT DOCUMENTS

| | | | |
|---|---|---|---|
| 2,527,711 | 10/1950 | Davidson | 30/151 |
| 2,859,516 | 11/1958 | McQueary | 30/151 |
| 2,901,823 | 9/1959 | Widen | 30/151 |
| 3,044,673 | 7/1962 | Manning | 224/232 |
| 3,200,021 | 8/1965 | Clark | 29/469 X |
| 3,257,050 | 6/1966 | Smith | 224/232 |
| 3,514,022 | 5/1970 | Eastman | 224/232 |
| 3,533,540 | 10/1970 | Carinci | 224/232 |
| 3,564,586 | 2/1971 | Legoff | 29/469 X |
| 3,576,278 | 4/1971 | Eastman | 224/232 |
| 4,122,984 | 10/1978 | Russell | 224/232 X |

*Primary Examiner*—Charlie T. Moon
*Attorney, Agent, or Firm*—Walter G. Finch

[57] ABSTRACT

A sheath and sheath knife wherein the sheath is of rigid construction fabricated from a formed metallic liner and a leather covering.

3 Claims, 5 Drawing Figures

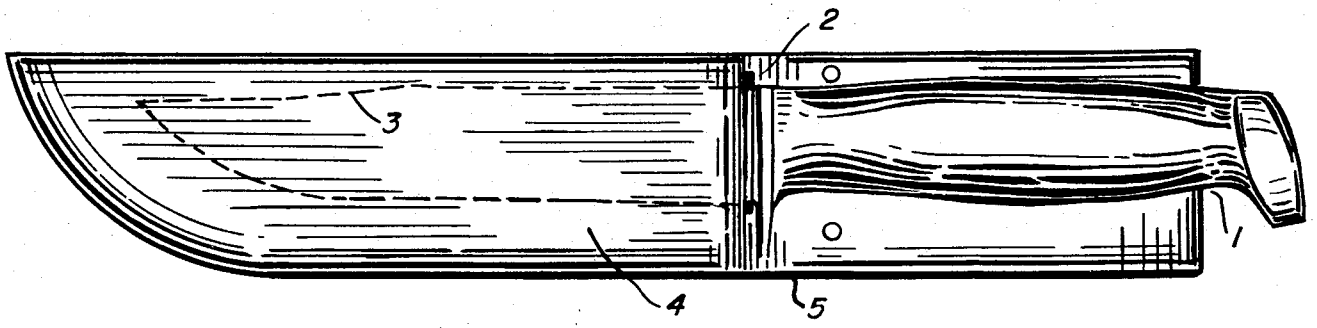
FIG. 1
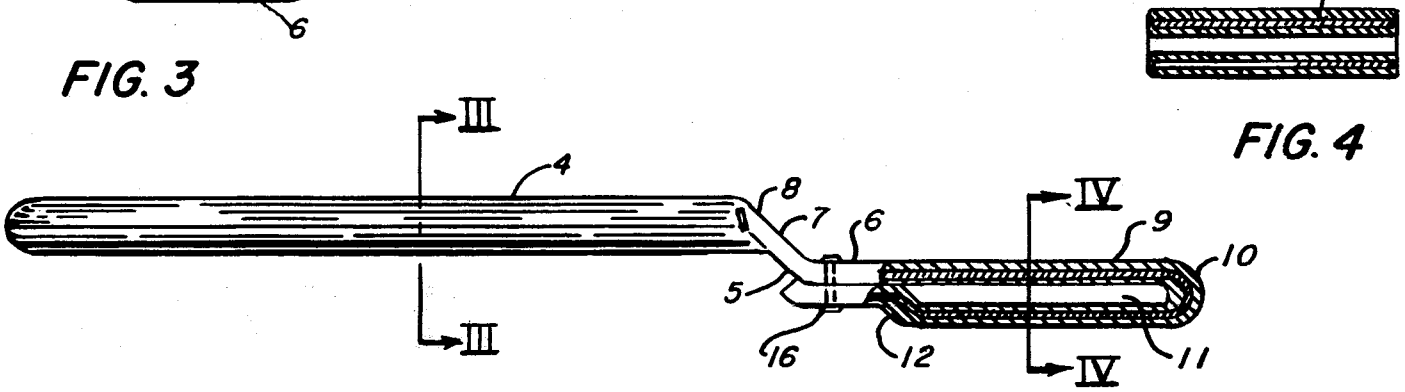
FIG. 2
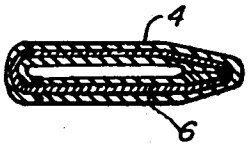
FIG. 3
FIG. 4

METHOD OF FABRICATING A SHEATH FOR A KNIFE

This is a divisional of U.S. Patent Application Ser. No. 91,387, filed Nov. 5, 1979 by the applicant, now U.S. Pat. No. 4,283,714, issued Apr. 28, 1981.

BACKGROUND OF THE INVENTION

This invention relates to a sheath knife and unique sheath device assembly. The assembly is of a nature incorporating a rigid belt type sheath device adapted to receive a waist-line belt through a belt loop portion thereof. The sheath device is configured to provide a discreet offset between the plane of the belt loop portion and its holding sheathing portion.

It is feature of the invention to provide a new and improved sheath device for a sheath knife of the hunting knife variety which provides greater comfort for the user thereof and greater rigidity of support for the sheath knife carried therein.

It is an object of the instant invention to provide a more durable and yet more comfortable sheath device and knife assembly which provides all of the advantages of sheaths for hunting-type sheath knives of the character heretofore or now in use and provides additional rigidity and protection for both the blade portion of the knife and the body of the wearer of the assembly.

Another object is to provide a sheath device and sheath knife assembly wherein the sheath device is of a rigid construction and is economical to manufacture in that thinner layers of leather material may be utilized in the construction of the portion of the sheath device overlying the metallic former incorporated therein.

Another object of the present invention is to provide an improved sheath device and knife assembly wherein the belt loop portion which is attached to the belt of the user is offset relative to the plane of the blade supporting and sheathing portion of the sheath knife assembly, in a manner to provide a more comfortable lay of the sheathing portion of the device against the leg or hip of the individual user wearing the sheath knife.

In correlation with the foregoing object it is an additional object to provide a sheath device of a sandwich-type construction in which rivet-type fastenings as utilized in the prior art sheaths are minimized and stitched methods of assembly for laminated sheath construction also of a nature well known in the prior art are obviated and yet a device is provided which provides greater serviceability and comfort for the individual when the assembly is in use.

Other objects, features and many of the attendant advantages of the sheath knife and sheath assembly of the invention will be more apparent from the following description of a preferred embodiment when taken in view of the accompanying drawing wherein:

FIG. 1 is a plan view of the knife and sheath device disposed together as an assembly;

FIG. 2 is an elevational view of the knife and sheath device with portions of the sheath device broken away to illustrate in section the sandwich-type construction of the belt loop portion which is adjacent to the sheath portion;

FIG. 3 is a sectional elevation view taken along the line III—III of FIG. 2;

FIG. 4 is a sectional elevation view taken along the line IV—IV of FIG. 2.

Figure 5:
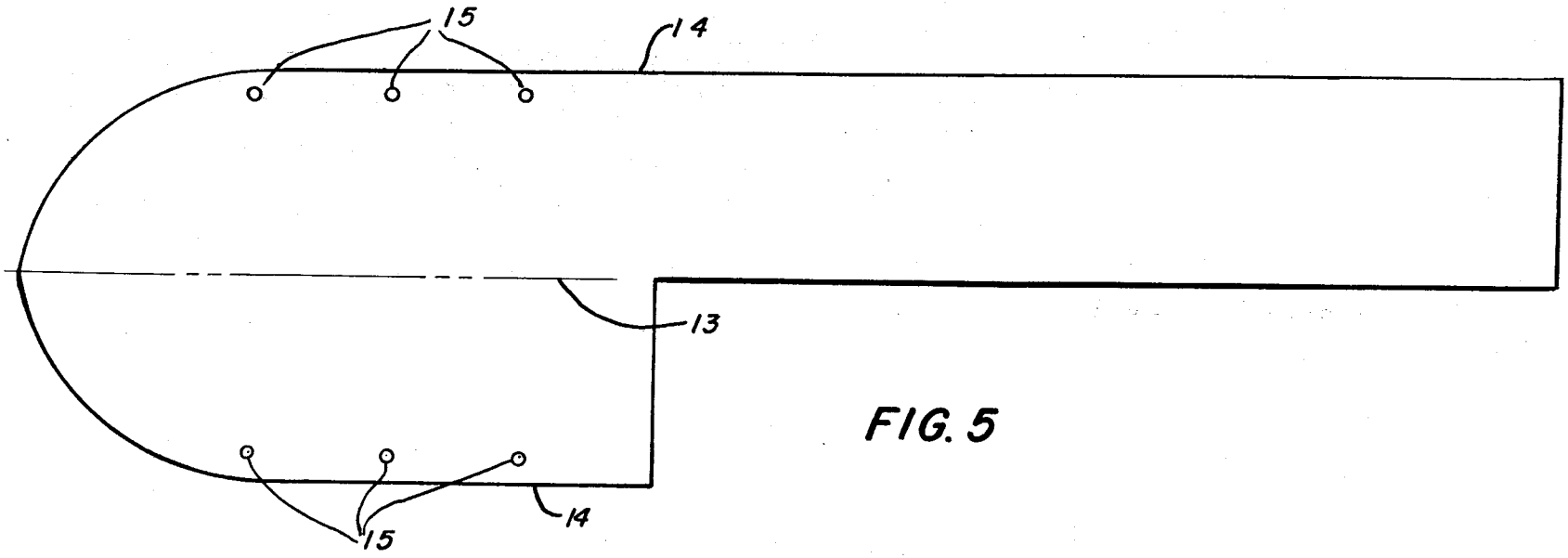
FIG. 5 is a plan view of the developed shape of the metallic insert prior to forming thereof.

Referring now to FIG. 1 of the drawings, there is a showing of the handle portion 1 of a hunting knife 2 of a conventional nature incorporating a steel blade 3, which is not visible in FIGS. 1 and 2 but is understood to be inserted in the sheath portion 4 of the sheath device 5 as indicated by the dash—line outline in FIG. 1. The handle portion 1 incorporates an assembly which is for all practical purposes manufactured integral with the blade 3. The handle 1 may be construced in any suitable manner as is well known in the art.

The sheath portion 4 is constructed generally in a configuration to conform to the outline of the blade 3 of the knife 2 with an extension around the periphery of the portion indicated at 4 where the knife is inserted therein to provide an overlap for protection of the blade and protection of the person using the sheath knife thereby to avoid accidental injury from the sharp cutting edge portion and point of the knife blade 3.

Referring now to FIG. 2 and more particularly to the broken-away portion indicated in section, the formed metal support or liner member 6 of the sandwich is configured with an offset at 7 between the terminal portion 8 of the upper end of the blade receiving section thereof and the portion 9 along which the handle 1 is intended to lie. The upper or other terminal portion at 10 of this off-set area is provided with a loop of a nature to permit passage of a belt therethrough at 11 whereby the user may carry the knife in the sheath device as an assembly dependent from a belt worn about the user's waist. The lower terminal portion 12 of the belt loop is deformed to return to a parallel position adjacent to the areas of the upper portion as indicated at 6 and 7 respectively.

The outer surface 4 of the sheath device 5 is of relatively thin leather such for example as deer skin or buck skin. It is thin as compared with the sole-type leather used for a sheath in the prior art. It is of such nature as to completely enclose the metal former or liner 6. It fits in a glove-tight manner about the insert or metal former member 6. In addition to providing protection for the knife blade 3 on the inside of the sheath portion, it also protects the wearer thereof. The foregoing disclosed construction renders the sheath device of the assembly relatively simple and economical to manufacture. Assembly is accomplished by gluing up the leather portions about all of the outer surfaces of the metal former member 6.

The cross sectional view of FIG. 3 indicates the general shape of the metal former 6 as disposed in sandwich-type form in the sheath portion 4. The cross sectional view of FIG. 4 indicates the construction which provides a belt loop as indicated by the void at 11.

The configuration of the metal former 6, preferably of aluminum alloy, as well as the developed configuration of the leather elements is indicated in FIG. 5.

After the former or liner 6 is bent to shape along line 13, the outer edges at 14 are fastened together by rivets at 15. The leather on the top and bottom is cemented over the rivets at final assembly. The belt loop portion is riveting together at 16.

While the invention has been described with reference to a preferred embodiment thereof which gives satisfactory results, it will be obvious to those skilled in the art to which the invention pertains, understanding the invention, that various changes and modifications may be made as to the fastening devices and the like by using other instrumentalities of a conventional nature without departing from the spirit and scope of the invention.

The presently disclosed embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein. The rigid former may be fabricated from other than a metallic material. The cross sectional shape of the blade enclosing sheath portion may be of alternative shape in cross section. Alternative cross sectional shapes envisioned include among others, rectangular, triangular, trapezoidal, airfoil, flattened teardrop and elliptical.

What is claimed and desired to be protected by Letters Patent is:

1. A method of fabricating a sheath device for a hunting knife assembly of a type adapted to encompass the blade of the hunting knife while leaving the handle portion thereof open ready for access, which comprises the steps of: forming a blank for an envelope like rigid metal former member for the blade portion of the knife; forming an extension from the aforementioned portion which is of a configuration adapted to close in a substantial loop of a character adapted for reception of a belt therethrough; covering all surfaces of the blank for the rigid former member with thin sheet leather, cutting the excess surfaces or areas of the leather beyond the configuration of the rigid former member after allowing a margin for riveting or stapling or stitching along the edges thereof, bending said blank to form said envelope like rigid metal former member with lapped marginal edges, joining said lapped edges by riveting, stapling or stitching and which comprises the additional step of cementing all surfaces of the leather to all surfaces contiguous with the metal former.

2. The method of claim 1 further comprising the step of forming said extension portion to provide a belt loop.

3. The method of claim 2 further comprising the step of riveting the terminal portion of said belt loop extension to fixedly close said belt loop.

* * * * *